US008654033B2

(12) United States Patent
Sorrell et al.

(10) Patent No.: US 8,654,033 B2
(45) Date of Patent: Feb. 18, 2014

(54) MULTI-LAYER HIGHLY RF REFLECTIVE FLEXIBLE MESH SURFACE AND REFLECTOR ANTENNA

(75) Inventors: Rodney Sorrell, Melbourne, FL (US); Frederick P. Turba, Palm Bay, FL (US); Mark Vanstrum, Indialantic, FL (US)

(73) Assignee: Harris Corporation, Melbourne, FL (US)

( * ) Notice: Subject to any disclaimer, the term of this patent is extended or adjusted under 35 U.S.C. 154(b) by 247 days.

(21) Appl. No.: 13/232,227

(22) Filed: Sep. 14, 2011

(65) Prior Publication Data

US 2013/0063322 A1 Mar. 14, 2013

(51) Int. Cl.
*H01Q 1/36* (2006.01)

(52) U.S. Cl.
USPC ..... 343/897; 343/912

(58) Field of Classification Search
USPC ..... 343/897, 912, 914
See application file for complete search history.

(56) References Cited

U.S. PATENT DOCUMENTS 4,191,604 A * 3/1980 MacTurk ..... 156/245
4,242,686 A * 12/1980 MacTurk ..... 343/912
4,609,923 A 9/1986 Boan et al.
4,812,854 A 3/1989 Boan et al.
5,680,145 A * 10/1997 Thomson et al. ..... 343/915
5,990,851 A * 11/1999 Henderson et al. ..... 343/915
6,268,835 B1 * 7/2001 Toland et al. ..... 343/781 P
2004/0113863 A1 * 6/2004 Stonier ..... 343/897

* cited by examiner

*Primary Examiner* — Hoanganh Le

(74) *Attorney, Agent, or Firm* — Fox Rothschild LLP; Robert J. Sacco

(57) ABSTRACT

The invention concerns a reflector (8) of radio frequency (RF) energy. The reflector includes a first web layer (9*a*) formed from a knit of at least a first conductive filament (11*a*), and a second web layer (9*b*) formed of a knit of at least a second conductive filament (11*b*). The first and second web layers can be formed as an open mesh 10. The second web layer is positioned on the first web layer to form a stack. Fastening members (14, 16) are disposed at intervals across a surface of each of the first and second web layers. The fastening members are advantageously configured to secure the first web layer to the second web layer. The invention also concerns a reflector antenna formed using the reflector of radio frequency energy. The reflector antenna includes antenna support elements (18), and the first and second web layers are secured to the antenna support structure to define a curved three dimensional surface.

20 Claims, 4 Drawing Sheets

MULTI-LAYER HIGHLY RF REFLECTIVE FLEXIBLE MESH SURFACE AND REFLECTOR ANTENNA

BACKGROUND OF THE INVENTION

1. Statement of the Technical Field

The inventive arrangements relate to antenna reflectors, and more particularly to antenna reflectors that are lightweight and highly reflective of radio frequency signals.

2. Description of the Related Art

Continuously expanding efforts in current-day communication technology, including satellite-based systems, require high performance signal transmission structures, such as mesh antennas, that may be deployable or non-deployable. Knit mesh materials have been used on high performance reflector designs and their continued use as reflector materials can be expected in the future.

Heightened interest in space reflectors operating at Ka band and higher frequencies has created a need for reflective surfaces that can operate at such frequencies. Conventional mesh materials are not suitable for frequencies above about 30 GHz. The reflectivity of the material diminishes with increasing frequency and undesirable characteristics become more apparent. For example, conventional mesh at frequencies above 30 GHz exhibits different reflectivity with respect to two orthogonal axes (x, y) aligned with the surface of the mesh.

The conventional practice for achieving improved performance at higher frequencies has been to create a finer mesh material. The current practice is to increase the number of openings per inch (OPI) as frequency increases. For example, 10 OPI mesh has been used for frequencies up to about 15 GHz. Even finer mesh materials of 18 OPI have been used to operate at frequencies up to about 30 GHz, albeit with some signal loss. Still, developing higher OPI mesh is expensive, risky and involves significant design challenges.

SUMMARY OF THE INVENTION

The invention concerns a reflector of radio frequency (RF) energy. The reflector includes a first web layer formed from a knit of at least a first conductive filament, and a second web layer formed from a knit of at least a second conductive filament. The second web layer is positioned on the first web layer to form a stack. Fastening members are disposed at intervals across a surface of each of the first and second web layers. The fastening members are advantageously configured to secure the first web layer to the second web layer. The invention also concerns a reflector antenna formed using the reflector of radio frequency energy. The reflector antenna includes an antenna support structure, and the first and second web layers are secured to the antenna support structure to define a surface, such as a curved three dimensional surface. The antenna support structure can be deployable or non-deployable, and can be composed of beam elements and/or cord elements.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1:
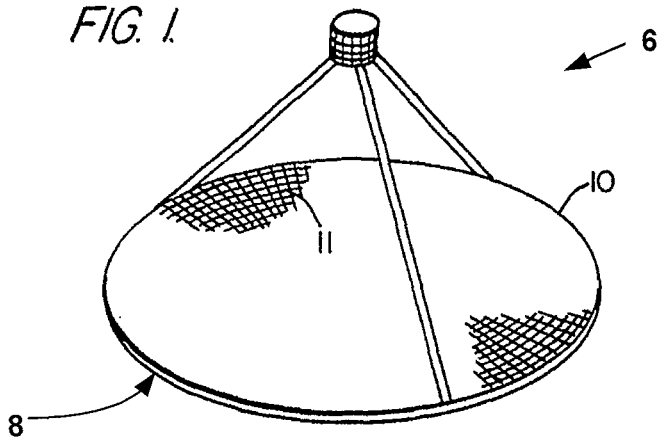
FIG. 1 is a reflector antenna which includes a reflector of radio frequency energy.
Figure 2:
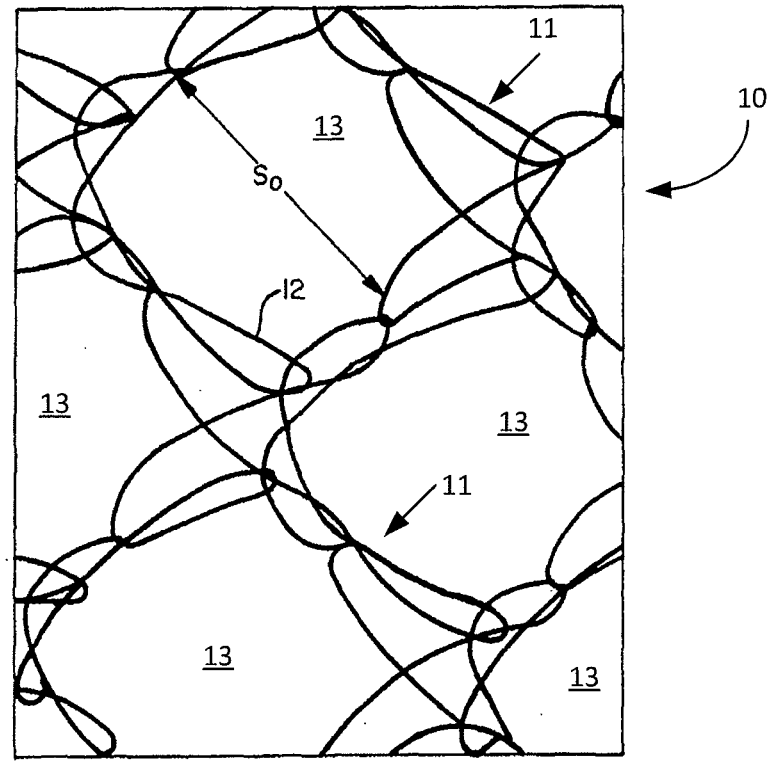
FIG. 2 is an enlarged view of an open mesh material that can be used as a web layer in the present invention.

Referring now to FIG. 1 there is illustrated a reflector antenna 6 having a reflector 8. Reflector antennas are well known in the art and therefore will not be described here in detail. However, it should be understood that the reflector antenna will have a support structure (not shown in FIG. 1). In some embodiments the support structure can be arranged so that the reflector 8 defines a curved three dimensional surface, such as a parabolic surface. Still, the invention is not limited in this regard and the support structure can also be arranged such that the reflector forms a two dimensional surface which is substantially planar. The reflector 8 is formed from a plurality of stacked web layers. As used herein, the term web layer refers to any membrane or fabric structure formed by knitting one or more filaments or fibers. According to an embodiment of the invention, the web layers are comprised of two or more layers of conductive open mesh 10. As shown in FIG. 2, an open mesh is a web layer that has openings 13 periodically formed across its surface as a result of the knitting process. Each web layer of open mesh 10 (hereinafter "mesh") is comprised of a network of highly conductive filaments 11 which define the openings 13 formed in the mesh. The highly conductive filaments provide a highly conductive mesh surface. As discussed below in greater detail, the number of openings in the mesh per inch (or other unit of measure) can be selected based the frequency of the RF energy to be reflected. In general, higher OPI values exhibit lower loss at higher frequencies. For frequencies above about 30 GHz, the mesh 10 should be greater than 18 OPI and preferably significantly greater than 18 OPI, although lower OPI values can be used with degraded performance. In general, each web layer of mesh 10 can define two opposing surfaces. These two opposing surfaces are best understood with reference to FIG. 4, which shows first and second opposing surfaces 20, 22.

As will be appreciated by those skilled in the art, a knitted web layer is different as compared to a woven web layer. In a knitted web layer, one or more filaments are formed into interlocking loops by the use of needles. In contrast, weaving involves interlacing two or more sets of filaments. Woven web layers are not generally stretchable. The advantage of knitted web layers is that they can stretch, which is an important consideration for antenna reflectors which are tensioned by a support structure, such as a support structure used to allow the mesh to define a three dimensional curved surface. In this regard, knitted web layers can be particularly advantageous for use with deployable and non-deployable reflector antennas.

In an embodiment of the invention, each web layer of mesh 10 is a knit type mesh configuration, as shown in FIG. 2. For example, a tricot knit can be used to form the mesh 10. Tricot knits are well known in the art. As illustrated in FIG. 2, each opening of the knit mesh is defined by multiple loops 12 formed of wire filaments. According to one aspect of the invention, at least one of the loops can be formed by the same wire folded back upon itself, such that relative displacement between loops or wire at different portions of the mesh is permitted. This arrangement ensures that the loops 12 at relatively different portions of the mesh may pass by one another and enter open regions of the mesh. The result is the loops are effectively mechanically displaceable with respect to one another in the contour of the mesh. For example, the loops may be displaced in response to changes in environmental (thermal) conditions, whereby the effective contour of the antenna formed by the mesh is retained. As is known in the art, this type of mesh has good mechanical properties both from a standpoint of manufacturability and handleability. Another advantage of tricot mesh is its inherent multiple twist loop properties, which ensure that a tear or cut in the mesh does not propagate. Still, it should be understood that the mesh is not limited to tricot knit mesh materials as described herein. Instead, any other conductive mesh material without limitation can be used in the present invention provided that the mesh has suitable electrical and mechanical properties.

The opening size of the mesh 10, i.e. spacing $S_0$ between loops 12, may be selected such that the open mesh has a range of between 10 to 31 openings per inch (OPI). In an embodiment of the invention, the mesh has a hole count of at least about 10 to 18 OPI measured along a diagonal. In a preferred embodiment, the mesh has a hole count of about 18 OPI, and can have a gauge of about 28. Still, the invention is not limited to the particular ranges of values stated herein for gauge and/or openings per inch. As will be appreciated by those skilled in the art, the word gauge refers to the number of knitting needles per inch that are used to knit the mesh. The filaments 11 forming wire loops 12 can be made from any highly conductive material that is compatible with the knitting process used to make the mesh. For example, the filaments can be formed of molybdenum, tungsten or other material that is surrounded by a layer of gold. In other embodiments, the loops can be formed of graphite filaments. Examples of tricot mesh, as described herein, are disclosed in U.S. Pat. Nos. 4,609,923 and 4,812,854.

As operating frequencies increase, the conventional practice has been to increase the OPI of the mesh in order to provide suitable electrical performance. However, due to the difficulty and expense in fabricating conductive mesh material greater than about 18 OPI, this conventional approach has proved to be increasingly impractical due to the difficulty of manufacturing very fine gauge mesh as described herein. Therefore, in accordance with a preferred embodiment of the invention, a new approach is provided in which a plurality of stacked web layers of mesh are used to form the reflector surface.

Figure 3:
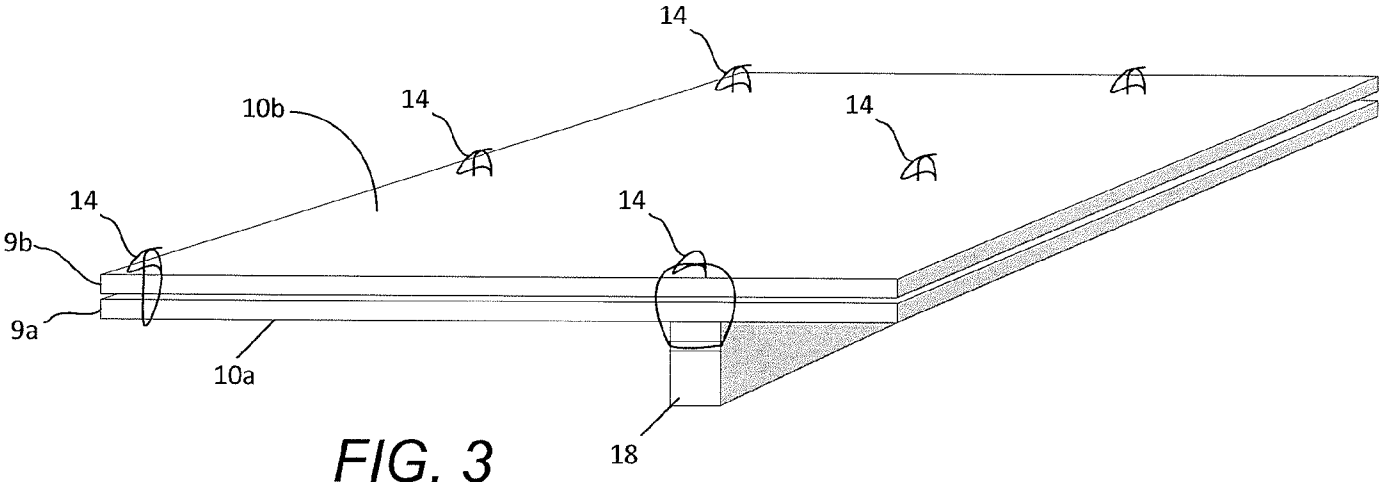
FIG. 3 is a drawing which shows a stack of web layers with filament type fastening members.

The plurality of stacked web layers of mesh 10 are shown in further detail in FIG. 3. More particularly, the plurality of stacked web layers includes a first web layer 9*a* formed of a mesh 10*a*, and a second web layer 9*b* formed of a mesh 10*b*. The first web layer is formed of at least a first conductive filament, and the second web layer is formed of at least a second conductive filament. Additional web layers formed of mesh are also possible, and the invention is not intended to be limited to two mesh web layers. Still, a preferred embodiment of the present invention can make use of two web layers of mesh as shown. In a preferred embodiment, the second layer of mesh 10*b* is placed directly on the first layer of mesh 10*a* such that the two web layers are in direct physical contact with each other. Mesh 10*a* can be the same or different type of mesh as compared to mesh 10*b*. Accordingly, mesh 10*a* can have the same or different gauge and/or openings per inch as compared to mesh 10*b*. Mesh 10*a* can also be formed of the same or different materials as compared to mesh 10*b*.

The plurality of web layers of mesh 10*a*, 10*b* can be fastened to each other by any suitable fastening device. In the embodiment shown in FIG. 3, the first layer of mesh 10*a* is secured to the second layer of mesh 10*b* by filaments 14 which form a closed loop extending through the first and second layers. The loop can be formed by needling or any other suitable process, and the loose ends of the filaments 14 can be tied, knotted or twisted together so that the loop remains closed. In place of or in addition to the filaments 14, other mechanical fasteners such as clips (not shown) can be used. The clips or mechanical fasteners can be arranged in a manner similar to that described herein with regard to the filaments for the purpose of securing together web layers of mesh 10*a*, 10*b*. Any clip or fastener now known, or known in the future can be used for this purpose, provided that it is suitable for securing the mesh layers together as described herein.

The locations of these filaments 14 can in some embodiments coincide with locations where the web layers of mesh 10*a*, 10*b* are secured to one or more support elements 18 forming the structure of a reflector antenna. As is known in the art, antenna support elements 18 can include struts, beams and/or cord elements. Also, it should be understood that the antenna support structure formed by support elements 18 can be a deployable or non-deployable arrangement, without limitation. The filaments 14 can also extend through or around a portion of the support elements. In this way, the same filaments can be used to secure the two layers of mesh 10*a*, 10*b* together, and to the support elements. Still, the invention is not limited in this regard and any suitable method can be used to attach the mesh 10*a*, 10*b* to the support elements 18, whether known now or known in the future.

Figure 4:
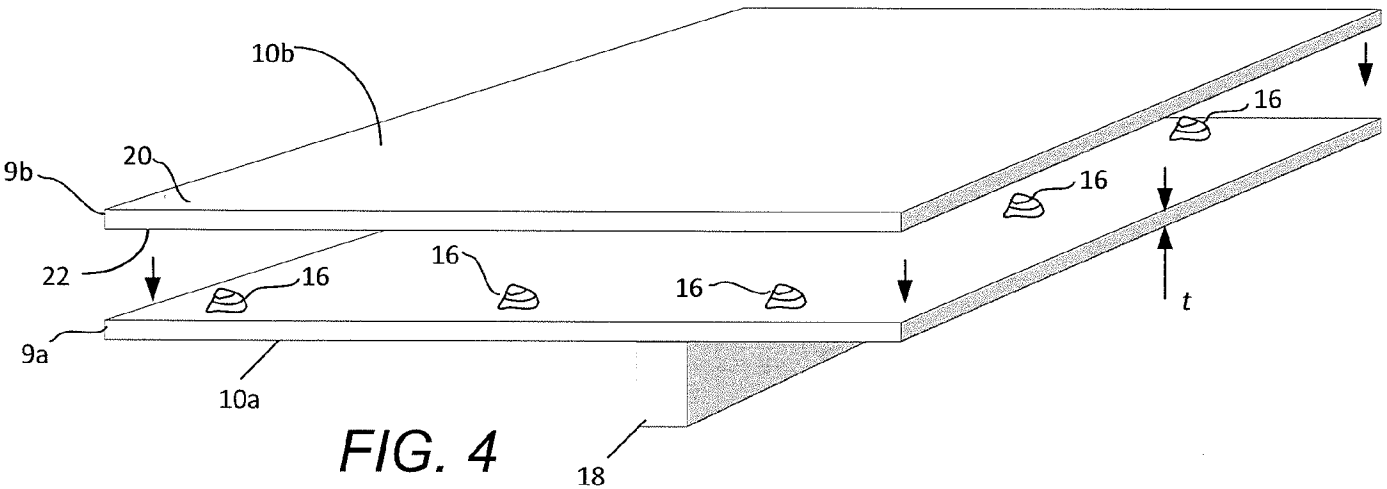
FIG. 4 is a drawing which shows how a stack of web layers can be fastened together using adhesive fastening members.

Other methods for attaching the web layers of mesh 10*a*, 10*b* are also possible. For example, in an embodiment of the invention, the two layers of mesh 10*a*, 10*b* can be tacked together with adhesive as shown in FIG. 4. In this scenario, adhesive 16 can be disposed between the layers in place of the filaments. For example, small amounts of the adhesive 16 can be positioned in spaced apart intervals (e.g. periodically) across the surface of mesh layer 10*b* on one side thereof, after which the two layers of mesh 10*a*, 10*b* can be stacked together as shown. Alternatively, the two layers of mesh 10*a*, 10*b* can be stacked together as shown and then adhesive 16 can be disposed on the stacked layers. The adhesive 16 can thereafter be allowed to cure, thereby securing the layers together. In some embodiments, a conductive adhesive can be used for this purpose. In some embodiments, the same or a different type of adhesive used to secure together the layers of mesh 10*a*, 10*b*, can be used to secure the layers to the support elements 18. Alternatively, a combination of adhesive 16 and filaments 14 can be used to secure the mesh to the support elements.

The fastening device used for attaching the first web layer of mesh 10*a* to the second web layer of mesh 10*b* are preferably disposed at fastening points located at intervals or spacings that are sufficiently small so as to ensure that gaps do not occur between the two layers in areas between such fastening devices. The exact spacing or interval between such fastening devices will depend on many factors such as the shape of the reflector, the design of the antenna support structure, the stiffness of the mesh, the tension in the mesh, and the operating frequency of the reflector antenna. The necessary spacing can also be affected by the overall size of the reflector. In general, fastening points for reflectors herein have a preferred spacing of about 2 to 20 inches. In an embodiment of the invention, the interval between some fastening devices that secure the two mesh web layers together can be periodic. In other words, the same spacing is used between some or all of the fastening devices. Still, the invention is not limited in this regard, and in some embodiments, different spacings can be used. Depending on the design of the antenna support structure, it may be advantageous to use one spacing in one direction (e.g., radial) and a different spacing in another direction (e.g., circumferential) to accommodate the preferred locations on the antenna support structure for securing the two layers of mesh 10*a*, 10*b* to the antenna support elements.

Due to the direct physical contact between the first layer of mesh 10*a* and the second layer of mesh 10*b*, and the conductive nature of the filaments 11 that form each layer, numerous electrical interconnections are formed by the two web layers. In a preferred embodiment, the gauge and the OPI of mesh 10*a*, 10*b* is selected so that when the two web layers of mesh 10*a*, 10*b* are stacked as shown in FIGS. 3 and 4, the plurality of layers function as one RF surface, thereby dramatically improving the reflectivity. This concept can be more fully understood with reference to FIGS. 5 and 6 where a second layer of mesh 10*b* formed of filaments 11*b* is shown disposed on top of a first layer of mesh 10*a* formed of filaments 11*a*. Note that in FIGS. 5 and 6, the filaments of 11*b* are shown in solid lines and the filaments 11*a* are shown in dotted lines so as to differentiate the two sets of filaments when they are shown in their overlaid or stacked position in FIG. 6.

Figure 5:
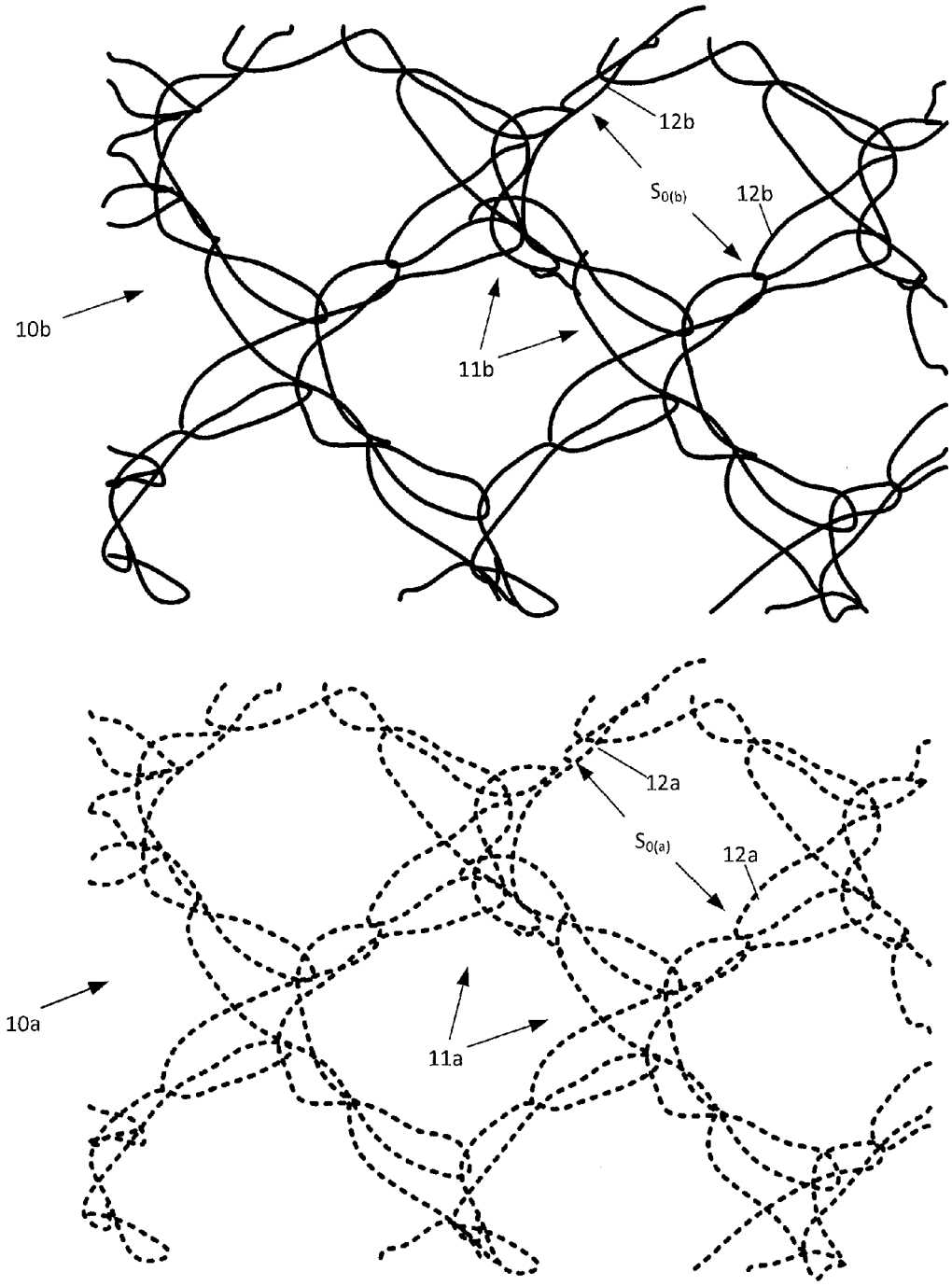
FIG. 5 shows a first open mesh and a second open mesh that can be assembled together to form a stack of web layers.
Figure 6:
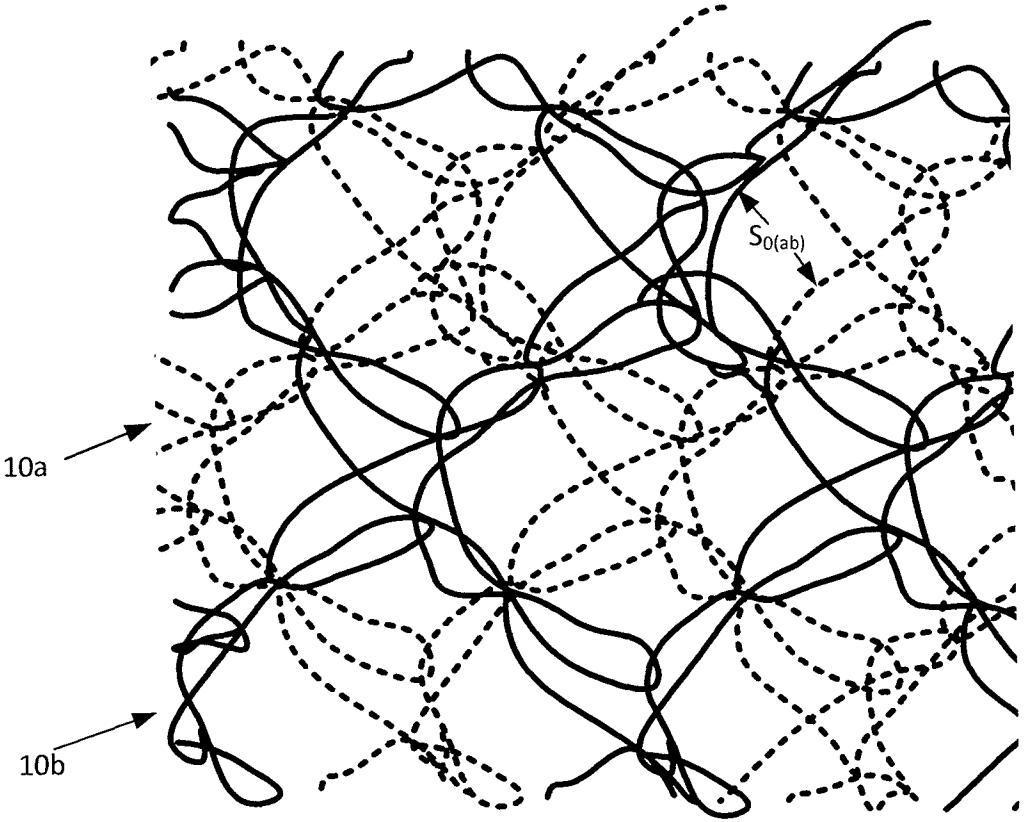
FIG. 6 is a drawing that is useful for understanding how a stack of open web layers can have smaller openings as compared to a single web layer.

Referring to FIG. 5, it can be observed that each web layer of mesh 10*a*, 10*b* has a spacing $S_{0(a)}$, $S_{0(b)}$ respectively between loops 12*a*, 12*b*. In a preferred embodiment of the invention, the spacing $S_{0(a)}$ for mesh 10*a* can be the same as the spacing $S_{0(b)}$ for mesh 10*b*, such that the two web layers of mesh have the same OPI. However, in an alternative embodiment of the invention, the spacing $S_{0(a)}$ for mesh 10*a* can be different as compared to the spacing $S_{0(b)}$ for mesh 10*b*, such that the two web layers of mesh have different OPI values. When the second layer of mesh 10*b* is stacked on top of the first layer of mesh 10*a* as shown in FIG. 6, the openings in mesh 10*a* will not generally be in alignment with the openings formed in mesh 10*b*. This misalignment can be due an intentional offset in the position of the mesh 10*a* relative to mesh 10*b*, and/or due to slight variations in the position of the openings resulting from the normal variations in the mesh fabrication process. As a result of the misalignment of openings, the loops and filaments forming mesh 10*a* will cross open areas defined by the filaments forming mesh 10*b*. As a consequence of this arrangement the size of the openings will be reduced. In a preferred embodiment, the gauge and the OPI of mesh 10*a*, 10*b* is selected so that when the two web layers of mesh 10*a*, 10*b* are stacked as shown in FIGS. 3 and 4, the average size $S_{0(ab)}$ of the openings resulting from the combined mesh layers is substantially reduced ($S_{0(ab)}<S_{0(a)}$, $S_{0(b)}$) thereby dramatically improving the reflectivity. For example, testing has shown that when the two web layers are 18 OPI mesh, the stacked layers in combination have an average reflectivity loss of less than about 0.2 dB for frequencies up to at least 50 GHz.

According to a preferred embodiment, the thickness t of each web layer of mesh 10*a*, 10*b* is chosen so that it is relatively small compared to the wavelength of the RF frequency that the combined mesh layers are intended to reflect. For example, the thickness of the layers is preferably less than one wavelength ($\lambda$), where $\lambda$ is the wavelength of the frequency to be reflected. For example, each of the layers of mesh 10*a*, 10*b* can have a thickness that is less than 0.25 inches. A typical thickness of a conventional 18 OPI mesh is about 0.02 inches. Accordingly, the thickness is negligible compared to the wavelength at frequencies up to about 50 GHz. Still, it should be understood that the thickness of the mesh is not critical and thicker or thinner mesh layers can be used, without limitation.

As is well known in the art, passive intermodulation occurs when two or more signals are present in a passive device that exhibits a nonlinear response. The nonlinearity can be caused by dissimilar metals, dirty electrical connections between metals, or other type of anodic effects. Loose electrical connections are also known to be a source of passive intermodulation. Accordingly, the arrangement of stacked layers of mesh as described herein would appear to have the potential to result in passive intermodulation. Surprisingly, and notwithstanding such expectations, it has been determined that the multiple layers of mesh 10*a*, 10*b*, when serving as an RF reflector as described herein, do not result in passive intermodulation in excess of typical intermodulation requirements for antenna reflectors. In fact, passive intermodulation testing performed using one and two layers of 18 OPI mesh at about 2 GHz has shown no observable difference in passive intermodulation performance. Notably, mesh used in antenna reflectors is normally tensioned in the deployed configuration. This normal tension in conjunction with the appropriate selection of spacing of fastening points (as described in FIGS. 3-4) ensures that gaps do not occur between the two layers in areas between fastening points. The direct physical contact between the first layer of mesh 10*a* and the second layer of mesh 10*b* in conjunction with the conductive nature of the filaments 11 that form each layer results in numerous electrical interconnections being formed by the two web layers. The numerous electrical connections minimize the potential for passive intermodulation.

A reflector for RF energy as described herein which is formed of a plurality of layers of mesh material can be used in any application where an RF reflector is needed. However, the invention is particularly useful when applied to reflectors used in antennas where light weight, solar transmissivity, low acoustic loading and/or high reflectivity are important design considerations. For example, the reflector arrangement described herein can be used in a parabolic antenna arrangement, and in particular, a deployable parabolic reflector arrangement where the reflector is designed to be folded or collapsed for transport purposes.

There is great interest in 2.6 meter to 9 meter mesh reflectors that operate at Ka band and higher frequencies. Multilayer mesh technology using currently available mesh materials allows such mesh materials to be applied to reflectors operating at frequencies at least as high as 50 GHz and potentially even higher. The multi-layer mesh reflectors described herein can be used in place of solid material reflectors that are now used in virtually all applications at frequencies above about 30 GHz. Significantly, multi-layer mesh reflectors as described herein have been found to be more reflective that other types of reflector material arrangements, including conventional triaxial weave solid reflectors. The multi-layer mesh reflectors described herein also have a substantial weight advantage as compared to solid reflectors. The exact savings in weight will depend on the design of the antenna support structure. However, it is estimated that reflector antennas constructed of the multi-layer mesh material can be more than 50% lighter as compared to conventional reflector antennas having solid reflectors. Other advantages of mesh materials as described herein include lower acoustic loading and higher solar transmissivity.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. A reflector of radio frequency energy, comprising:

a first web layer formed from a knit of at least a first conductive filament;

a second web layer formed from a knit of at least a second conductive filament, and positioned on the first web layer to form a stack, said first and second web layers comprising a single common reflecting surface;

a plurality of fastening members disposed at intervals across a surface of each of the first and second web layers and configured to secure the first web layer to the second web layer at said intervals to define a plurality of spaced apart fastening points where said first web layer is attached to said second web layer, wherein a spacing between said fastening points is defined by said intervals.

2. The reflector according to claim 1, wherein the first web layer is formed of a first open mesh and the second web layer is formed of a second open mesh.

3. The reflector according to claim 2, wherein each of the first and second open mesh material has the same number of openings per inch.

4. The reflector according to claim 2, wherein each of the first and second open mesh is formed of multiple loops of the filaments defining openings, at least one of the loops is defined by the same filament folded back upon itself, and the first and second open mesh is configured to permit relative displacement between loops of filaments at different portions thereof.

5. The reflector according to claim 1, wherein the plurality of fastening members are comprised of filaments extending from the first web layer to the second web layer.

6. The reflector according to claim 1, wherein the plurality of fastening members are mechanical clips which secure the first web layer to the second web layer.

7. The reflector according to claim 1, wherein the plurality of fastening members are formed of an adhesive material.

8. The reflector according to claim 1, wherein at least one of the fastening members is secured to a support member for the reflector.

9. The reflector according to claim 1, wherein the reflector is disposed in a support structure to define a curved three dimensional surface.

10. The reflector according to claim 1, wherein said spacing along said surface in a first direction is different as compared to said spacing along said surface in a second direction.

11. A reflector antenna, comprising:

an antenna support structure;

a first web layer formed from a knit of at least a first conductive filament;

a second web layer formed from a knit of at least a second conductive filament, and positioned on the first web layer to form a stack, said first and second web layers comprising a single common reflecting surface;

a plurality of fastening members disposed at intervals across a surface of each of the first and second web layers and configured to secure the first web layer to the second web layer at said intervals to define a plurality of spaced apart fastening points where said first web layer is attached to said second web laver, wherein a spacing between said fastening points is defined by said intervals; and wherein the first and second web layers are secured to the antenna support structure.

12. The reflector antenna according to claim 11, wherein the first web layer is formed of a first open mesh and the second web layer is formed of a second open mesh.

13. The reflector antenna according to claim 12, wherein each of the first and second open mesh material has the same number of openings per inch.

14. The reflector antenna according to claim 12, wherein each of the first and second open mesh is formed of multiple loops of the filaments defining openings, at least one of the loops is defined by the same filament folded back upon itself, and the first and second open mesh is configured to permit relative displacement between loops of filaments at different portions thereof.

15. The reflector antenna according to claim 11, wherein the plurality of fastening members are comprised of filaments extending from the first web layer to the second web layer.

16. The reflector antenna according to claim 11, wherein the plurality of fastening members are mechanical clips which secure the first web layer to the second web layer.

17. The reflector antenna according to claim 11, wherein the plurality of fastening members are formed of an adhesive material.

18. The reflector antenna according to claim 11, wherein at least one of the fastening members is secured to the support structure.

19. The reflector antenna according to claim 11, wherein the first and second web layers secured to the antenna support structure define a curved three dimensional surface.

20. The reflector according to claim 11, wherein said spacing along said surface in a first direction is different as compared to said spacing along said surface in a second direction.

* * * * *